US008333054B2

(12) United States Patent
Hartl

(10) Patent No.: US 8,333,054 B2
(45) Date of Patent: Dec. 18, 2012

(54) PACKAGE WITH HANDLE AND DEVICE AND METHOD FOR THE PRODUCTION THEREOF

(75) Inventor: Michael Hartl, Raubling (DE)

(73) Assignee: Krones AG, Neutraubling (DE)

( * ) Notice: Subject to any disclaimer, the term of this patent is extended or adjusted under 35 U.S.C. 154(b) by 138 days.

(21) Appl. No.: 12/428,578

(22) Filed: Apr. 23, 2009

(65) Prior Publication Data

US 2009/0266732 A1 Oct. 29, 2009

(30) Foreign Application Priority Data

Apr. 23, 2008 (DE) ..... 10 2008 020 522

(51) Int. Cl.
*B65B 29/04* (2006.01)

(52) U.S. Cl. ..... 53/413; 53/134.1; 53/398; 53/443; 53/462; 206/432

(58) Field of Classification Search ..... 53/398, 53/441, 557, 442, 443, 462, 134.1, 413; 206/432
See application file for complete search history.

(56) References Cited

U.S. PATENT DOCUMENTS

| | | | | |
|---|---|---|---|---|
| 3,557,516 | A | 1/1971 | Brandt | |
| 3,756,395 | A | 9/1973 | Ganz | |
| 3,834,525 | A * | 9/1974 | Morgese et al. | 206/161 |
| 3,866,386 | A * | 2/1975 | Ganz | 53/398 |
| 4,050,216 | A * | 9/1977 | Stenberg | 53/413 |
| 4,422,281 | A * | 12/1983 | Rensner | 53/134.1 |
| 4,830,895 | A * | 5/1989 | Bernard | 428/34.2 |
| 4,906,319 | A | 3/1990 | Fiorani | |
| 5,050,368 | A * | 9/1991 | Noh | 53/442 |
| 5,067,612 | A * | 11/1991 | Tsuchiya et al. | 206/497 |
| 5,797,247 | A * | 8/1998 | Nakagoshi et al. | 53/442 |
| 6,354,739 | B1 | 3/2002 | Sheehan, Jr. et al. | |
| 6,513,657 | B2 | 2/2003 | Sheehan, Jr. | |
| 2002/0157980 | A1 | 10/2002 | Sheehan, Jr. | |
| 2005/0132665 | A1 | 6/2005 | Angelini | |
| 2005/0247031 | A1 * | 11/2005 | Floding et al. | 53/442 |

FOREIGN PATENT DOCUMENTS

| | | | |
|---|---|---|---|
| DE | 43 32 419 | A1 | 4/1994 |
| EP | 0 178 142 | A1 | 4/1986 |
| EP | 0 717 712 | B1 | 6/1996 |
| GB | 2 271 098 | A | 4/1994 |
| WO | WO 2008/047305 | A2 | 4/2008 |

* cited by examiner

*Primary Examiner* — Thanh Truong
(74) *Attorney, Agent, or Firm* — Simpson & Simpson, PLLC

(57) ABSTRACT

A method for producing a plurality of packages of liquid containers including the steps of dividing the liquid containers into groups representing the packages, applying handles to a film, wherein the film is located in a feeding area for the film, supplying one film to each of the groups of liquid containers via the feeding area, and wrapping each group of liquid containers with the film and the applied handle, thereby completing the packages.

8 Claims, 2 Drawing Sheets

PACKAGE WITH HANDLE AND DEVICE AND METHOD FOR THE PRODUCTION THEREOF

CROSS REFERENCE TO RELATED APPLICATIONS

This patent application claims priority of German Patent Application No. DE 10 2008 020 522.2, filed on Apr. 23, 2008, which application is incorporated herein by reference in its entirety.

FIELD OF THE INVENTION

The present invention relates to a package of at least two liquid containers. The invention particularly relates to a package wherein at least two liquid containers are arranged as a package with the help of a film. At least one handle is fixed to the upper side of the package.

The invention also relates to a method for producing a plurality of packages of liquid containers. The liquid containers are first divided into groups. Then a film is supplied to the grouped liquid containers via a feeding area. Finally, each group of liquid containers is wrapped with the film.

The invention further relates to a device for producing a plurality of liquid containers each having at least one handle.

BACKGROUND OF THE INVENTION

In the technical field of the present invention, packages essentially consist of at least two liquid containers, such as PET bottles or beverage cans, and a plastic film for packaging and/or holding together groups of liquid containers. The plastic film may additionally be shrunk by a thermal process so that the liquid containers are optimally held together. A thus produced package may be carried by a person at a handle attached to the package. The handle may, for example, be a loop attached to the surface of the shrink package by means of a self-adhesive handle adhesive tape.

Currently, filling systems usually use separate handle application machines for applying the handles to the shrink packages, which apply the handle to the shrunk package downstream of the shrink film machine and the shrink tunnel. One disadvantage thereof is that the shrink package offers little counter-pressure for pressing the self-adhesive handle adhesive tape against it when the handle is applied, particularly if a handle is adhered to the concavity between two liquid containers. A further disadvantage is that the speed of the application head of the handle application machine must be synchronized with the package speed or vice versa. Some space must be provided for the handle application machine within the filling system.

According to some devices and methods known from prior art, the packaging films are initially provided wound up as a roll, such as in European Patent Application EP 0 178 142 A1 and U.S. Pat. No. 6,513,657 B2. Therefore, the films must be unwound for applying the handles, and the handles are then applied to the film. Next, the film, which now includes the handles, is wound up again and supplied to other operations in the filling system. This means that two operations are necessary for winding up and unwinding the film. In addition, there are bulges in the rolls in the wound up state due to the applied handles, which may, on the one hand, result in undesired wear of the film and, on the other hand, makes it difficult to store the rolls of film.

Due to the additional machine element for applying the handles, additional functions are required, such as separating packages that have accumulated one behind the other. Thus the packages are arranged for applying the handles and/or the application head is synchronized with the speed with which the packages are transported through the filling system. These additional functions reduce the overall efficiency of the filling system.

According to various devices and methods known from prior art, packaging films are prepared to include handles before the films are supplied to the packaging device for the packages so that a flexible reaction to different package designs is not possible during the filling operation, if necessary, see, for example, U.S. Pat. No. 6,513,657 B2. In addition, such prepared films are more expensive than non-prepared films.

Various patents of this category for packages having handles and methods for the production thereof are known from prior art and will be described briefly in the following.

European Patent Application EP 0 178 142 A1 discloses a method for packaging liquid containers that includes forming at least one handle. Before the packaging film is heat-shrunk, portions of the film are weakened along central portions of the longitudinal edges of the film such that, as a consequence of heating the film, the weakened portions of the film form openings. The openings are arranged adjacent to the handles so that users may grip the handles through the openings. The handles are pre-applied to the film, i.e. the films are prepared to include handles. The film is unwound for applying the handles and subsequently wound up again. This has a negative effect on the performance of the packaging machine. In addition, the film roll bulges where the handles are applied. There is a risk of jamming during unwinding.

U.S. Pat. No. 3,756,395 discloses a shrink package and a method for the production thereof. Before a plastic film used for the packaging is shrunk, strips are folded locally in some areas of the film within this film, or other types of reinforcing strips are added. The strips may be reinforced by lamination. The strips are applied in areas of the film where a handle is to be provided and where the tension on the film caused by carrying the package is compensated. In this way the shrink package is stabilized.

European Patent Application EP 717 712 B1 discloses multiple packaging for bottles and a method for the production thereof. In a region separating adjacent rows of bottles, a film of heat-shrinkable plastic comprises a series of aligned incisions extending over the whole perimeter of the packaging, which are designed to form a line for detaching each row of bottles from the adjacent row(s) of bottles.

U.S. Pat. No. 6,513,657 B2 discloses a packaging with a handle-forming tear opening. A tearable tape system having a first and a second section is secured to the packaging material. The first section is tearable relative to the second section. The second section remains secured to the packaging material and, in combination with the packaging material, forms a handle. A first slit is formed through the packaging material adjacent a side of the tear opening to allow grasping the handle in the opened state. The handles are pre-applied to the packaging material, i.e. the packaging material is prepared to include handles. In addition, the packaging material is wound up again with the handles applied before the liquid containers are wrapped with the packaging material to form packages.

U.S. Pat. No. 6,354,739 B1 discloses tear control adhesive tapes and containers with a tear control adhesive tape. A container for storing items is provided with a flap of a tear resistant film material with first and second major surfaces for closing the container. A tearable tape strip is located on one of the first and second major surfaces of the flap. A loop-shaped handle is not provided.

BRIEF SUMMARY OF THE INVENTION

It is an object of the invention to provide a method for producing a plurality of packages of liquid containers provided with handles which increases the overall efficiency of a filling system for the liquid containers.

The above object is achieved by a method for producing a plurality of packages of liquid containers comprising the steps of: dividing the liquid containers into groups representing the packages; applying handles to a film, wherein the film is located in a feeding area for the film; supplying one film to each of the groups of liquid containers via the feeding area; and, wrapping each group of liquid containers with the film and the applied handle and thus completing the packages.

It is a further object of the invention to provide a device for producing packages of liquid containers with handles that operates time and cost effectively.

The above object is achieved by a device including a package of at least two liquid containers comprising a film arranging the at least two liquid containers as a package, wherein the film consists of a shrinkable material, and at least one handle, which is fixed to the package and applied before the liquid containers are wrapped with the film and the package is completed, and wherein the handle comprises a non-shrinkable material.

It is a further object of the invention to provide a package of liquid containers with at least one handle that may be produced in an inexpensive way.

The inventive method for producing a plurality of packages of liquid containers includes applying handles to a film before the liquid containers are grouped, wrapped with separate portions of the film and the groups of liquid containers are completed to form packages. While the handles are applied to the film, the film is located in a feeding area of a device of a filling system for the liquid containers. Via the feeding area, one portion of the film at a time is supplied to each of the groups of liquid containers.

In a preferred embodiment of the inventive method, the handles are applied to the film by means of at least one application head. The application head may be designed according to prior art. In particular, the handles may be fastened to the film by means of the application head, for example with the help of an adhesive or lamination. It is particularly advantageous for the durability of the handles on the film if a roller or shaft cooperating with the application head is arranged opposite the application head. The application head and the roller or shaft press at least one of the handles firmly onto the portion of the film currently located between the application head and the roller or shaft. Then the roller or shaft advances the film with the applied handles.

The film may, for example, be implemented as a continuous film. In this embodiment, the film is divided into film portions, as they are required for the completion of the packages, only after the handles have been applied. In another embodiment, however, the handles are applied to already separated portions of the film.

For allowing a user to easily tear the completed packages, it is advantageous to add perforations in the film, for example before the groups of liquid containers are wrapped with the film and the packages are completed. The perforations may be added to the film by means of at least one perforation blade as known from prior art. In addition or alternatively, at least one gripping slit per handle may be cut into the film, again for example before the groups of liquid containers are wrapped with the film and the packages are completed. The gripping slits may be cut into the film by means of at least one cutting blade.

The order of the steps of applying the handles to the film, adding the perforations and/or the gripping slits to the film and dividing the film may vary and is not essential for the scope of the invention.

In one embodiment of the inventive method, the film is subjected to a heat-shrink process, and the grouped liquid containers are wrapped with the shrunk film and thus arranged as packages. In a further embodiment, the gripping slits are added to the film prior to the heat-shrink process so that the gripping slits will open during the heat-shrink process to be gripped later on by the user. However, the gripping slits may also be added to the film after the liquid containers have been arranged as packages with the help of the film.

One advantage of the inventive method is that special, often expensive films prepared to include handles are not required. This allows the filling plant to be more flexible when purchasing packaging means such as film and handles. Since the film packaging may easily be opened due to the perforations added in the means, a special, expensive adhesive tape having this function is not required.

The inventive device for producing a plurality of packages of liquid containers each having at least one handle operates according to the steps of the inventive method described above. As described above, it may include at least one application head which is located in the feeding area for the film and applies the handles to the film. Within the device, the application head is arranged upstream, in the direction of film travel, of a station of the device that at least partially wraps the grouped liquid containers with the film.

As described above, the device may include at least one cutting blade for cutting gripping slits into the film and/or for dividing the film, and at least one perforation blade for adding perforations to the film.

The inventive package includes at least two liquid containers, wherein the at least two liquid containers are arranged as a package with the help of a film, and at least one handle is fixed to the package. The at least one handle of the package is applied by the inventive device and the inventive method before the liquid containers are wrapped with the film and before the package is completed. As described above, the film may essentially consist of a shrinkable material and form the package of liquid containers by means of shrinking.

It is advantageous if the handle of the inventive package essentially consists of a non-shrinkable material so that the handle will not be deformed in an undesired way and thus may no longer be easily gripped by the user. Such materials are known from prior art. The handles do not become detached from the film during the heat-shrink process, because the adhesives usually used for the permanent bonding of the handle to the film only detach at temperatures higher than the temperature used for the heat-shrink process.

As described above, the package may have at least one gripping slit added to the film per handle, wherein the gripping slit is arranged to be adjacent to the corresponding handle. In addition or alternatively, at least one perforation may be added to the film for tearing the film packaging.

BRIEF DESCRIPTION OF THE DRAWINGS

In the following, embodiments will explain the inventive method, the inventive device and the inventive handle and their advantages in more detail with reference to the accompanying drawings.

In the drawings.

DETAILED DESCRIPTION OF THE INVENTION

Figure 1:
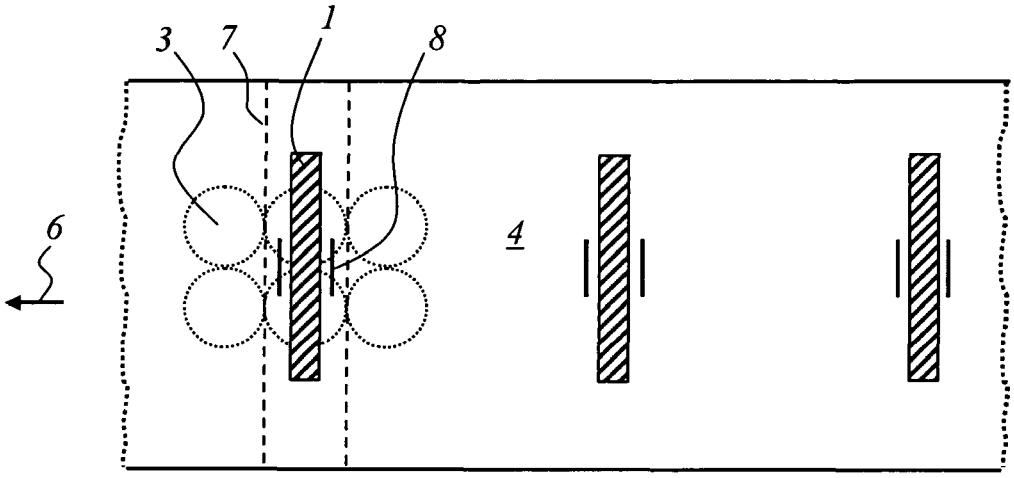
FIG. 1 shows a schematic top view of a portion of a film spread flatly, with applied handles and added perforations and gripping slits.

FIG. 1 shows a schematic top view of a portion of a film 4 or film web spread flatly, for example for a three-line packaging machine simultaneously wrapping three package groups arranged next to each other (not shown) with the film per cycle. Three handles 1 are applied to the illustrated portion of film 4. In the embodiment of the handle 1 shown, to the left and right of the longitudinal sides of each of the handles 1 a perforation 7 is added and a gripping slit 8 is cut into the film 4.

The six dotted circles shown with the handle 1 on the left side indicate the areas on the film 4 where, in a later operation of the inventive device 10 (not shown, see FIGS. 4 and 5), liquid containers 3 are arranged as complete inventive packages 2 with the help of portions of the film 4, according to the inventive method, in an example of a package 2 (not shown) including six liquid containers 3. The handles 1 are positioned on the film 4 with spacings therebetween corresponding to the dimensions of the packages 2 to be produced.

The film 4, which may, for example, be supplied in three parallel lines, is transported through the inventive device 10 in a direction of travel 6 of the film 4. FIG. 1 shows the already cut film 4 according to an operation of the device 10 with the inventive method before the groups of liquid containers 3 are wrapped with the film 4 and the packages 2 are completed.

Figure 2:
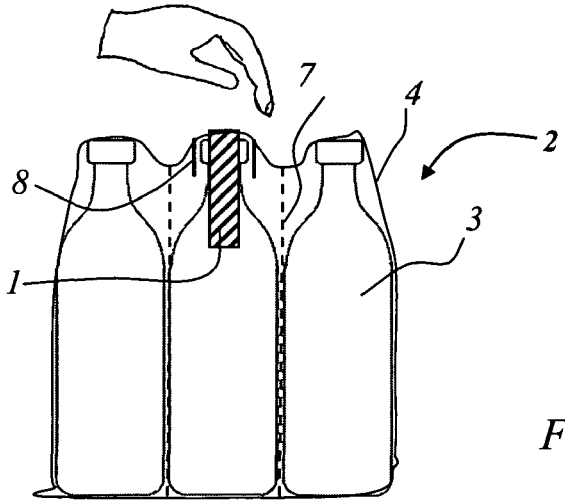
FIG. 2 shows a schematic side view of a package including the inventive handle and the perforations and gripping slits.

FIG. 2 shows a schematic side view of the inventive package 2 including the handle 1 and the two perforations 7 and the two gripping slits 8 of FIG. 1. FIG. 2 shows the completed package 2 after the corresponding group of liquid containers 3 has been wrapped with the film 4 and the package 2 has been completed.

Due to an appropriately sized, at least partial wrapping of the liquid containers 3 realized by the device 10 and the inventive method, the handle 1 is positioned on the upper side of the package 2. The gripping slits 8 into which a user may insert his/her fingers for a better grip of the handle 1 are arranged to the left and right of the handle 1.

The two perforations 7 are now located between the three pairs of liquid containers 3. By tearing one of the two perforations 7, the user may easily remove one or more liquid containers 3 from the film packaging.

Figure 3:
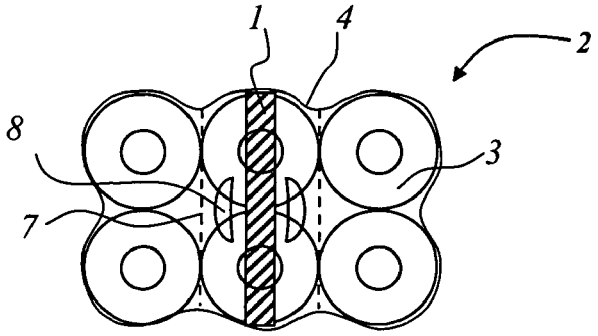
FIG. 3 shows a schematic top view of the package including the inventive handle and the perforations and gripping slits.

FIG. 3 shows a schematic top view of the inventive package 2 including the handle 1 and the two perforations 7 and the two gripping slits 8 of FIGS. 1 and 2. By shrinking the film 4 onto the liquid containers 3, the gripping slits 8 are widened, for example crescent-shaped in this case, so that the user may insert his/her fingers into the gripping slits 8 even more easily.

Figure 4:
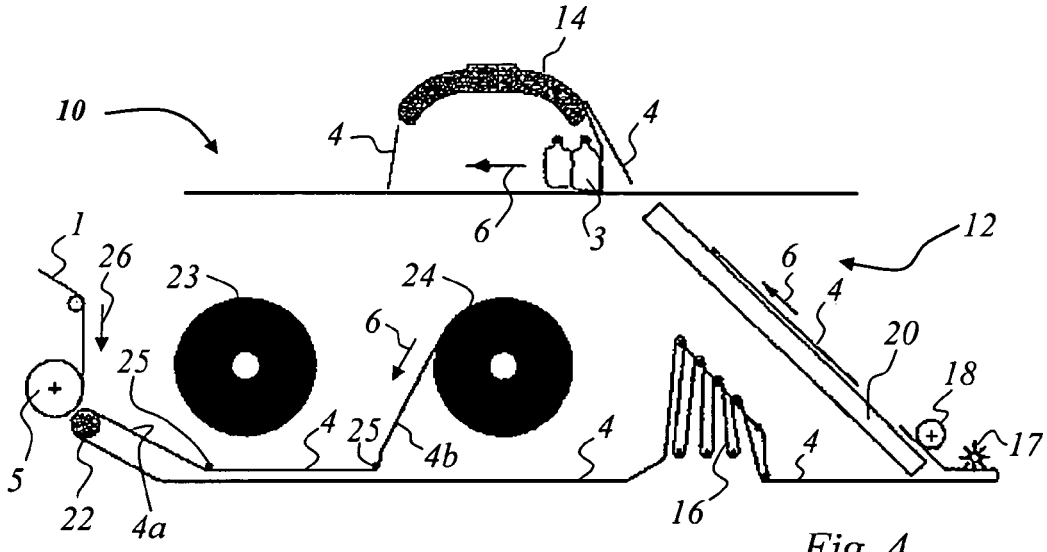
FIG. 4 shows a schematic side view of an embodiment of the inventive device, wherein the device is set such that the handles are applied to the inner surface of the film; and, FIG. 5 shows a schematic side view of the device of FIG. 4, wherein the device is adapted such that the handles are applied to the exterior surface of the film.

FIG. 4 shows a schematic side view of an embodiment of the inventive device 10, wherein the device 10 is set such that the handles 1 are applied to the inner surface 4*a* of the film 4. The essential steps of the inventive method will be described in the following with reference to device 10.

Device 10 includes a film mandrel carrying a roll 24 having the film 4 wound thereupon. If, in the embodiment of device 10 shown, the film 4 is completely unwound from the roll 24, the film 4 may be unwound from an adjacent spare roll 23, and in the meantime a new roll 24 with film 4 may be placed on the corresponding film mandrel.

Device 10 further includes guide elements 25 via which the film 4 is transported to an application roller 22 in the travel direction 6. In order to apply the handles 1 to the inner surface 4*a* of the film 4, the film 4 is first driven over the guide elements 25 such that the film 4 is moved from top to bottom so that the exterior surface 4*b* of the film 4 runs over the application roller 22.

The application roller 22 cooperates with an application head 5 of device 10. The handles 1 are supplied to the application head 5 from a travel direction 26. Depending on the embodiment of device 10, the handles 1 may be supplied to the application head 5 separately as single units or, for example, still joined to each other in the form of a tape, wherein the tape is separated into individual handles 1. It is not essential for the scope of the invention how the handles 1 are supplied. With the help of the at least one application head 5, at least one handle 1 is applied to an area of the film 4 in parallel with the travel direction 6 of the film 4. This area of the film 4 is positioned on the application roller 22 opposite the application head 5. By rotating and pressing the application head 5 against the application roller 22, the handles 1 are fixed to the film 4, for example by additional heating, laminating and/or by adhesives previously applied to the handles 1. In multi-line film processing, one handle 1 is applied to each film web per cycle.

In the embodiment of device 10 shown, the film 4 with the handles 1 applied thereto is then transported to a dancer 16 according to prior art, through which the film 4 then passes. The dancer 16 serves for compensating the speed differences occurring in device 10 depending on the operation performed, as the film 4 is transported.

In the embodiment of device 10 shown, the film 4 is now supplied to at least one perforation blade 17 which adds the perforations 7 and gripping slits 8 described in FIGS. 1-3 to the film 4. Subsequently the parallel film webs are cut into individual units by means of at least one cross-cutting blade 18 of the device 10 (see FIG. 1). The perforation blades 17 may also be arranged downstream of the cross-cutting blades 18 in device 10 (not shown) without departing from the scope of the following claims.

Film 4 is now provided with handles 1, perforations 7 and gripping slits 8, and the film 4 is then, for example, advanced as individual units to a film wrapping apparatus 14 of the device 10 via a conveyor 20 of the device 10. Here, by at least partially wrapping them with film 4, the liquid containers 3 are prepared in groups for the following elements (not shown) of device 10 for heating and, if necessary, shrinking the separate films 4 onto the liquid containers 3.

The feeding area 12 via which the film 4 is supplied to the grouped liquid containers 3 from below, before they are wrapped with the film 4 and the packages 2 are completed, is preferably aligned with and below the conveyor carrying the liquid containers 3 in device 10, and the same applies to the application head 5 and the application roller 22, which allows a very compact and space-saving design.

Figure 5:
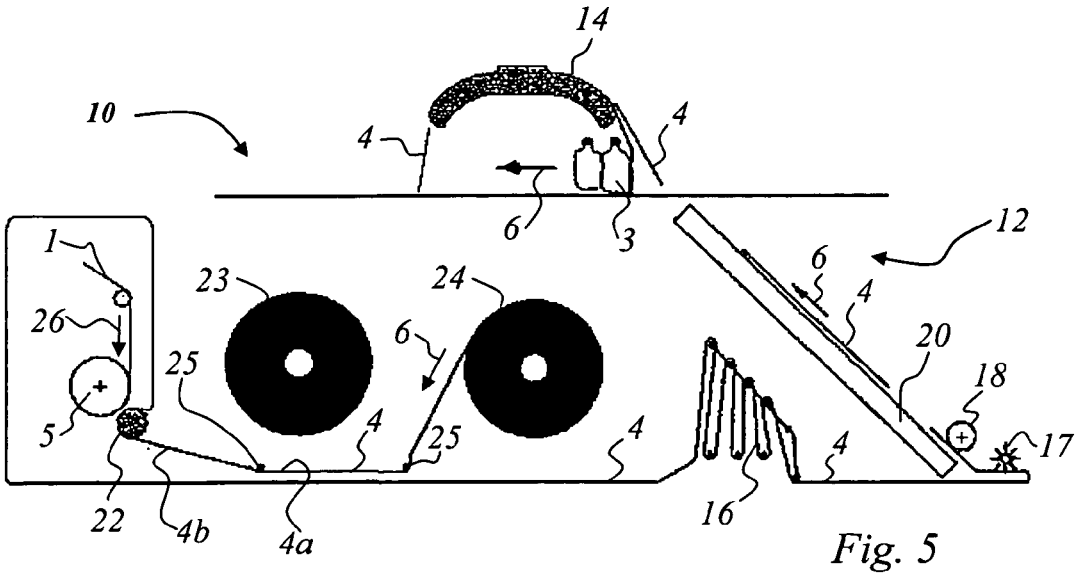

FIG. 5 shows a schematic side view of another embodiment of the device 10 illustrated in FIG. 4, wherein the device 10 is adapted such that the handles 1 are applied to the exterior surface 4*b* of the film 4. In order to achieve this, the film 4, which is unwound from roll 23 or 24, merely has to be supplied to the application roller 22 in the opposite direction. The film 4 is driven over the guide elements 25 such that the film 4 runs from bottom to top and thus the inner surface 4*a* of the film 4 runs over the application roller 22. All other elements of the device 10 and the essential method steps have already been described in connection with FIG. 4.

The invention has been described with reference to a preferred embodiment. However, someone skilled in the art will understand that modifications or changes may be made to the invention without departing from the scope of the following claims. In particular, the perforations 7 may be omitted or may have a different shape and/or number, the gripping slits 8 may be omitted or may have a different shape and/or number, the handles 1 may be applied to the film 4 by different methods and devices, the liquid containers 3 may have shapes and/or sizes differing from what is shown in the drawings, the number and arrangement of the liquid containers 3 per package 2 may differ, the device 10 may include different and/or further elements, and the method may correspondingly include different and/or further steps without departing from the scope of the following claims. The application head 5 and the application roller 22 in device 10 may also be arranged downstream of or between the perforation blade 17 and the cutting blade 18 without departing from the scope of the following claims. An essential feature of the present invention is that the handles 1 are applied to the film 4 before the grouped liquid containers 3 are wrapped with the film 4 and the packages 2 are completed, and after the film has been unwound from the roll 23 or 24 or any other suitable film dispenser.

What is claimed is:

1. A method for producing a plurality of packages of liquid containers comprising the following steps:

providing a packaging machine with a film without handles from a supply roll;

applying one separate handle for each wrapping to a portion of the film in the packaging machine, wherein the handle is applied in parallel with a direction of travel of the film between at least one application head in the packaging machine and an application roller positioned opposite the application head, and wherein the at least one handle is applied to the film while the film of the packaging machine is still located in a feeding area for the film and before the liquid containers are wrapped with the film;

advancing the film in the feeding area with the application roller to a dancer in the feeding area;

dividing the film into film portions only after the handles have been applied;

arranging the liquid containers into groups representing the packages;

supplying one single film portion, to which at least one handle is applied, to each of the groups of liquid containers via the feeding area; and, wrapping each group of liquid containers with the single film portion and the applied handle, thereby completing the packages.

2. The method of claim 1, wherein the handles are applied to the film, the film is arranged as a continuous film and the film is divided only after the handles have been applied.

3. The method of claim 1, wherein at least one perforation is added to the film before the groups of liquid containers are wrapped with the film and the packages are completed.

4. The method of claim 1, wherein at least one gripping slit per handle is cut into the film before the groups of liquid containers are wrapped with the film and the packages are completed.

5. The method of claim 4, wherein the gripping slits are added to the film prior to a heat-shrink process and open during the heat-shrink process to be gripped later on.

6. The method of claim 1, wherein the film with which the grouped liquid containers are wrapped arranges the liquid containers as packages by means of a heat-shrink process.

7. The method recited in claim 1, wherein prior to said step of wrapping, said method further comprises:

creating at least one perforation in the film extending across an entirety of the film in the direction of travel of the film, wherein the perforation is operatively arranged to enable easy opening of the packages.

8. The method recited in claim 1, further comprising:

providing a dancer for compensating speed differences on opposite sides of the dancer as the film is transported through the packaging machine, wherein the application head and application roller are provided between the supply roll and the dancer in the direction of travel of the film.

* * * * *